US009364941B2

(12) United States Patent
Olkowski, Jr.

(10) Patent No.: US 9,364,941 B2
(45) Date of Patent: Jun. 14, 2016

(54) MALE THREADED PIPE FITTING EXTRACTION DEVICE

(71) Applicant: Stanley Olkowski, Jr., Novi, MI (US)

(72) Inventor: Stanley Olkowski, Jr., Novi, MI (US)

(73) Assignee: KSO ENTERPRISES, INC., Novi, MI (US)

( * ) Notice: Subject to any disclaimer, the term of this patent is extended or adjusted under 35 U.S.C. 154(b) by 23 days.

(21) Appl. No.: 14/207,898

(22) Filed: Mar. 13, 2014

(65) Prior Publication Data

US 2014/0310934 A1 Oct. 23, 2014

Related U.S. Application Data

(60) Provisional application No. 61/780,550, filed on Mar. 13, 2013.

(51) Int. Cl.

| | |
|---|---|
| ***B66C 1/56*** | (2006.01) |
| ***B25B 13/50*** | (2006.01) |
| ***B25B 13/02*** | (2006.01) |
| *B25B 27/18* | (2006.01) |

(52) U.S. Cl.

CPC ..... *B25B 13/5083* (2013.01); *B25B 13/02* (2013.01); *B25B 27/18* (2013.01); *Y10T 29/49815* (2015.01); *Y10T 29/53687* (2015.01)

(58) Field of Classification Search

CPC ... B23F 15/00; B23F 17/00; Y10T 29/49462; Y10T 29/49478; Y10T 29/4948; Y10T 29/49467; B21J 5/00; B21J 5/025; B21J 5/12; B21K 1/30; B21K 1/305; B23P 15/14

See application file for complete search history.

(56) References Cited

U.S. PATENT DOCUMENTS 3,216,292 A * 11/1965 Flegal ..... 81/53.2
4,189,266 A * 2/1980 Koslow ..... B23B 51/0009 408/224

* cited by examiner

*Primary Examiner* — David Bryant
*Assistant Examiner* — Jun Yoo
(74) *Attorney, Agent, or Firm* — Stephen T. Olson; Harness, Dickey & Pierce, P.L.C.

(57) ABSTRACT

The present invention relates to tools or devices which are commonly used for extracting or removing damaged or broken male threaded pipe fittings from their female threaded fitting counterparts. Said damaged male pipe fittings are often removed or extracted as a cost savings measure, in order to salvage the female fitting portion. This avoids the necessity and cost of discarding and replacing both the damaged or broken male fitting, as well as the undamaged female fitting or fittings. This salvage process is especially cost effective in cases where the broken or damaged male pipe fitting in question, is part of a larger, more expensive plumbing assembly or system.

11 Claims, 9 Drawing Sheets

Figure 4D
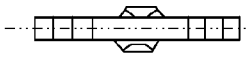
Figure 4E
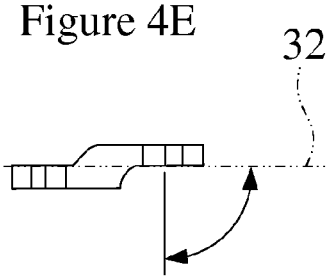
Figure 4F
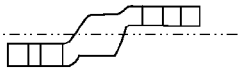
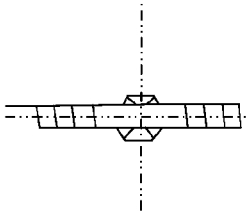
Figure 4G
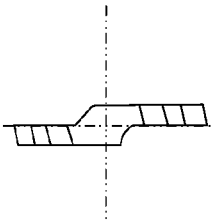
Figure 4H
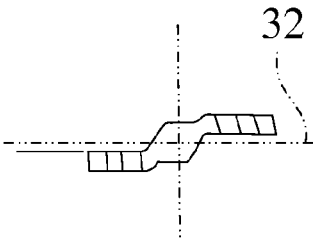
Figure 4I Diag. Corner to Corner = Pilot Dia.

MALE THREADED PIPE FITTING EXTRACTION DEVICE

CROSS-REFERENCE TO RELATED APPLICATIONS

This application claims the benefit of U.S. Provisional Application No. 61/780,550, filed on 13 Mar. 2013. The entire disclosure of the above application is incorporated herein by reference.

FIELD

The present disclosure relates to a male threaded pipe fitting extraction device.

BACKGROUND

This section provides background information related to the present disclosure which is not necessarily prior art.

A male threaded pipe fitting may fracture within a counterpart female threaded pipe fitting. In such a situation, removal of the male threaded pipe fitting may be difficult. Typically, broken male threaded pipe fittings are extracted using known devices that generally fall into one of three categories:

One known device for extracting a broken male pipe fitting has a conical or tapered configuration, with left-handed helical teeth, or left-hand sharpened (for extracting right-hand threaded fittings), straight-edged teeth or blades which are co-axial with the axis of the tool. The teeth or blades are typically multiple in number, radially disposed, and equally spaced.

A second known device for extracting a broken male pipe fitting has a tapered pyramid or conical fashion, with a triangular, square, pentagonal, hexagonal, or other regular polygon cross-section. The edges along the cross-sectional corners of this pipe extraction device are sharp which enable them to embed into the inside diameter of the fitting to facilitate extraction.

A third known device for extracting a broken male pipe fitting is of the expanding type. This device has straight or knurled teeth along the longitude of its gripping surface, and expands outwardly to cylindrically engage with the inside diameter of the broken pipe fitting when removal (counterclockwise) torque is applied to the tool.

All of these devices grip the broken male pipe fitting either partially (conically) or entirely (cylindrically) on an inside diameter of the pipe fitting at or near the exposed and broken edge or mouth of the damaged fitting. These tools can be, but are not always successful for extracting broken metallic (steel, brass, iron or aluminum) pipe fittings in order to reclaim the reusable mating part. However, in the case of non-metallic fittings (plastic, PVC, CPVC, Nylon, etc.) these tools often fail to successfully extract the broken male pipe fitting, due to the fact that the tool pressure exerted upon the contact area is so great, that rather than gripping the male pipe fitting, the tool tends to machine or carve the softer plastic materials. Additionally, the increased elasticity of plastic, in particular, PVC pipe fittings tends to work against extraction efforts because these tools expand the fitting, thereby increasing the necessary removal torque. This in turn destroys the broken fitting to the extent that it can no longer be extracted, rendering the previously usable mating female pipe fitting unusable and therefore scrap.

While known tools for extracting a broken male pipe fitting may have proven useful for certain circumstances, a need for improvement in the relevant art exists.

SUMMARY

This section provides a general summary of the disclosure, and is not a comprehensive disclosure of its full scope or all of its features.

The present teachings generally provide a tool for engaging a broken fitting entirely on the exposed broken face or edge of the fitting to be extracted. Extraction tools based upon prior art conically or cylindrically engage to the inside diameter at or near the exposed broken edge. The present teachings provide greater gripping effectiveness or capability in terms of utilization of the tool pressure that is applied by the tool to the workpiece (broken fitting) during the extraction process. This minimizes the free machining of the broken fitting which thereby optimizes the extraction torque.

The present teachings provide an extraction technique that also eliminates expansion from within the damaged male pipe fitting by the extraction tool, during the removal process. This, in turn, reduces the necessary removal torque to only that which is required to overcome the original assembly torque, plus any thermal and environmental factors present, as compared to overcoming the original assembly torque, plus overcoming frictional torque created by the expansion of the damaged male pipe fitting in addition to thermal and environmental factors. In the case of extracting non-metallic fittings, the present teachings are particularly advantageous because frequently, the torque required to machine the fitting material by common, present day extraction tools, can be considerably less than the required removal torque. Hence, material is removed from the workpiece fitting by the common, ordinary, present day extraction tool, rather than extracting the fitting from the salvaged piece, in its entirety.

The tool of the present teachings may be made from a variety of materials. Specific material selection may be dependent upon the material from which the workpiece (damaged or broken) male pipe fitting was comprised. For example, mild carbon steels or even aluminum may be adequately suitable, if the tool were intended strictly for use on plastic or Poly Vinyl Chloride (PVC) workpiece fittings. Alternately, if the tool were intended for use on metallic fittings, such as steel or brass, the tool may perform better with a material with a higher carbon content, for tool heat treatment and hardening purposes. In this case, most any file-hard steel, or in extreme cases for longer tool life, high-speed tool steel would be a more suitable choice.

In the case of high volume tool manufacturing and production, the tool may be cast, molded, stamped, forged or even near-net or net-formed powdered metal or sintered metal process manufactured, from the appropriate material that would provide adequate finished tool hardness for its intended application and reasonable tool life expectancy. Carbide, ceramic and porcelain are also viable material options.

In accordance with one particular aspect, the present teachings provide an apparatus for extracting a damaged male threaded pipe fitting from a counterpart female threaded pipe fitting. The apparatus includes a blade portion and a drive shank. The blade portion includes a pair of blade faces and a pair of diametrically opposed, cylindrical pilot diameter segments. The drive shank integrally extends from the blade portion. The apparatus is adapted to engage the damaged male threaded pipe fitting entirely on an exposed broken face or edge of the damaged male threaded pipe fitting.

In accordance with another particular aspect, the present teachings provide a method of extracting a damaged male threaded pipe fitting from a counterpart female threaded pipe fitting. The method includes providing an apparatus including a blade portion and a drive shank. The blade portion includes a pair of blade faces and a pair of diametrically opposed, cylindrical pilot diameter segments. The drive shank integrally extends from the blade portion. The method additionally includes engaging the damaged male threaded pipe fitting entirely on an exposed broken face or edge of the damaged male threaded pipe fitting. Further, the method includes rotating the damaged male threaded pipe fitting relative to the counterpart female threaded pipe fitting to extract the damaged male threaded pipe fitting from the counterpart female threaded pipe fitting.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure. It should be noted that all dimensions shown in all views are exemplary and are in inches.

FIGS. 4A-4I illustrates further variations of an extraction device in accordance with the present teachings.

Corresponding reference numerals indicate corresponding parts throughout the several views of the drawings.

DETAILED DESCRIPTION

Figure 1A:
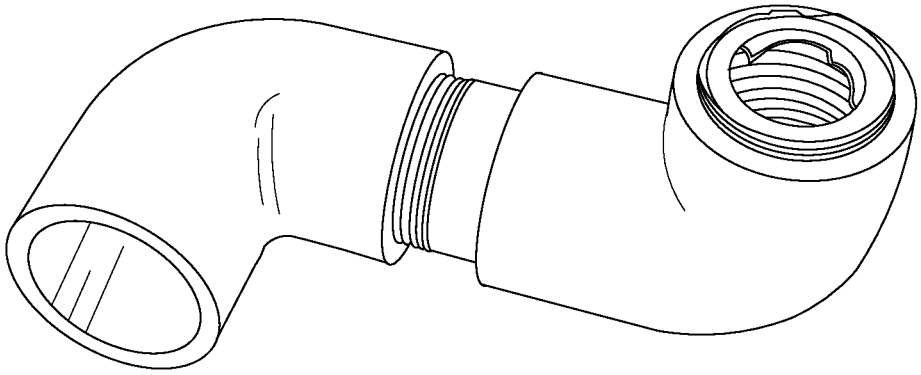
FIG. 1A is a perspective view of an installed, damaged, male pipe fitting prior to extraction.

Example embodiments will now be described more fully with reference to the accompanying drawings.

The tool or apparatus of the present teachings is identified generally throughout the drawings at reference character 10. As shown in the views of FIGS. 2A-2E, the apparatus 10 may include a flat blade portion (1). In one application, the flat blade portion (1) may be approximately 1/16" thick or greater, and may form two, flat blade faces (2). The flat blade faces (2) may either be parallel or form a slight angle relative to one another. The flat blade faces (2) may be disposed symmetrically about a pair of axial planes, which are perpendicular to one another.

At one end, these flat blade faces (2) may be integrally attached to a round drive shank (3). The length of the drive shank (3) may vary within the scope of the present teachings. In this regard, the drive shank (3) may be short, medium or long in length. In an alternate embodiment, a segment near the end of the drive shank portion (4) may be triangular, square or hexagonal in cross-section shape, or any other regular polygon that will facilitate mounting in a driver device, such as a drill motor, and spinning the tool concentrically about a coaxial axis. This optional configuration is intended to prevent slippage while the tool is inserted into the chuck of the torque providing drive tool, which would again, typically be a drill motor, wrench, or similar device, none of which are part of the present invention. The drive shank (3) and its axis are concentric with all other diametrically opposed features of the extraction tool.

At the end opposite the drive shank the circumferential periphery of the flat blade portion (1) may be configured into two diametrically opposed, cylindrical pilot diameter segments (5). The cylindrical pilot diameter segments (5) may also be concentric about the drive shank (3) and a tool axis (6), and form a pilot diameter (7) of the apparatus 10. The pilot diameter segments (5) may be sized appropriately to provide a close slip-fit into the inside diameter of the broken pipe fitting to be extracted. The pilot diameter segments (5) maintain the apparatus 10 concentric with a fitting (workpiece), during a broken fitting extraction process. The pilot diameter need only be sufficient enough in longitudinal length to maintain extraction engagement edges (8) of the apparatus 10 in contact with the exposed broken fitting edge face during the extraction process.

Two extraction engagement edges (8) may be immediately adjacent and perpendicularly disposed relative to the pilot diameter segments (5). Alternatively, an angle of the extraction engagement edges (8) may either be slightly acute or slightly obtuse relative to each of their respective, adjacent associated, pilot diameter segments (5). An extraction engagement edge diameter (9) of the extraction tool at the extraction engagement edges (8), may be of sufficient size to allow full engagement of the extraction engagement edges (8) to the workpiece's broken fitting edge face, while at the same time, small enough so as not to engage into, or machine the minor diameter of the female thread in the female pipe fitting piece to be salvaged.

Departing from each of the extraction engagement edges (8) are tool clearance rake angle faces (11). These faces may form an acute angle with one of their respective adjacent flat blade faces (2), the vertices of which are at the extraction engagement edges (8). The angle may be of any reasonable amount less than 90 degrees. However, it should be noted that the lower the angle, the thinner the extraction engagement edges (8) become, hence more fragile and more susceptible to damage during normal use. Viewing a right-hand thread extraction tool from the bottom with the viewer's line of sight parallel to the tool axis (6), the tool clearance rake angle faces (11) are arranged such that they depart from the plane of their respective adjacent extraction engagement edges (8) in a counter-clockwise fashion and away from the viewer. This arrangement enables the tool to bite into and firmly grip the exposed broken fitting edge face, when the pilot diameter (7) is inserted into the inside diameter of the broken fitting, and axial force is applied engaging the extraction engagement edges (8) to the fitting's exposed broken edge.

Proximal to an extractor largest outside diameter and further toward the round drive shank portion (3), the apparatus 10 may include tool blend areas (12). The tool blend areas (12) define a transition area that may afford an opportunity for the apparatus 10 to taper down from the extractor largest outside diameter (11), to the round drive shank portion (3). Which, as earlier mentioned, is a round cross-section cylindrical diameter portion, to which can be attached the hexagonal drive shank portion (4) which is hexagonal or can be any other regular polygon in cross-sectional shape. This also provides an opportunity to blend the tool's shape from the flat blade portion (1), to the round drive shank portion (3) and or optional hexagonal (or regular polygon shaped) drive shank portion (4), previously described. Furthermore, the drive shank (3) may even be entirely, for its full length, hexagonal, or other regular polygon in cross sectional shape.

Embodiment for a Multiple-Size Extraction Device

To increase the versatility of the apparatus 10 of the present teachings the apparatus 10 may incorporate multiple tool sizes integrated or conjoined together to create a single tool that can be used to extract multiple pipe fitting sizes. In this regard, the apparatus 10 may include multiple steps (13) fashioned into a single tool so that this single tool may be used to extract more than one size of pipe fitting. Described more specifically, a single tool, designed for multiple fitting sizes, would ideally accommodate the extraction of several consecutive sizes of pipe fittings. For example, the same tool could be designed to extract ½" and ¾" as well as 1" (or greater or lesser) National Pipe Thread pipe fittings. Multiple steps (13) for additional sizes may either be added to a single tool or grouped together on a separate tool. This can be accomplished by utilizing the extraction engagement edge outside diameter(s) (or flats), which have been designed for the extraction of one size of pipe, as the pilot diameter(s) (7) for the extraction of the next larger pipe size.

Embodiment for a Left-Hand Thread Extraction Device

Generally, an extraction tool designed for extracting left-hand pipe fittings would embody the same features as one designed for right-hand fittings, except that the features would be arranged in a symmetrically opposite fashion from the similar features on a right-hand thread extraction tool. That is to say that when viewed from the bottom end of the tool, or from its extraction engagement edges (8) end, with the viewer's line of sight parallel to the tool axis (6), the tool would have tool clearance rake angle faces (10), which depart from their respective adjacent extraction engagement edges (8) on the flat blade portion (1), in a clockwise rather than counter-clockwise direction. This slightly different, symmetrically opposite embodiment facilitates the extraction tool to grip and rotate the exposed broken fitting edge face and drive the tool in a clockwise direction when the tool pilot diameter (7) is inserted into the broken fitting, with axial force applied to the tool, to engage the extraction engagement edge (s) (8) to the broken fitting's exposed edge face. Likewise, the tool would then be driven in a clockwise direction to effect broken fitting extraction of a left-handed thread pipe fitting. However, left-handed thread pipe fittings are extremely rare. Therefore, the majority of the tool devices manufactured and in use would likely be of the right-hand thread extraction variety. It should also be noted that a multiple size left-hand thread male pipe fitting extractor tool, that is, a single tool designed for use on multiple sizes of pipe fittings, could be designed by adding multiple steps (13), in like fashion to that described previously for the multiple-size right-hand fitting extraction tool.

Additional Embodiment Enhancements and Variations Therein of the Male Pipe Fitting Extraction Device for Extracting Right or Left-Hand Threaded Fittings (Right-Hand Thread Extraction Device Illustrated)

With reference to FIGS. 3A-3K, an alternative apparatus constructed in accordance with the present teachings is illustrated and identified generally at reference character 100. Given the similarities between the apparatus 10 and the apparatus 100, like reference characters will be used to identify like features. The apparatus 100 may include a pilot diameter (7) and/or an extractor largest outside diameter (11) (or diameters in the case of a multi-size tool) configured into a cylindrical shaped pilot diameter (14) or any quadrennial segmented pilot diameter (15) or portion thereof, or a singular or multiple array of extraction edges, either equally or unequally placed about the tool's longitudinal axis. Likewise, cylindrical extraction engagement edge diameter(s) (16) may also be cylindrical and quadrennially segmented extraction engagement edge diameters (17), instead of those features being fashioned into a flat blade portion (1) of the apparatus 10, as in the preferred embodiment. Again, the apparatus 100 may include singular, or multiple quadrennial segments, (18) and (19) respectively, or an extraction edge or a multiple of edges, either equally or unequally spaced about the tool's longitudinal axis. Additionally, the apparatus 100 may include a singular extraction engagement edge (20). Alternatively, the apparatus 100 may include multiple extraction engagement edges (21).

Additional features for the apparatus 100 may include slight chamfers (22) or corner radii (23) or sharp corners (23A) at the root of the extraction engagement edge(s) (8) and at the extraction engagement edge tips (24) on their outer periphery. With the exception of the sharp corner embodiment, these features would further enhance and facilitate insertion of the pilot diameter (7) into the fitting to be extracted, when the pilot diameter is one and the same as the extraction engagement edge diameter (9) for the extractor of the next size smaller pipe fitting, as in the case of a multiple-size extraction tool.

In certain embodiments, the apparatus 100 may include flats (25) on an outer periphery of the pilot diameters (7) and extraction engagement edge tips (24), such that the diagonal dimension(s) (26) were equivalent to the required pilot diameter necessary for piloting the tool into the fitting to be extracted.

Further in certain embodiments, the apparatus 100 may include an undercut (27) at internal vertices of the pilot diameters to the extraction engagement edge (8). These undercuts (27) may either be plunged into the extraction engagement edge (8), axially (longitudinally) or into the pilot diameter(s) (7), radially, or both. These features would allow for a "sharp corner" effect in the areas described, by eliminating even the slightest inside corner radius that would have the potential of coming in contact with the broken edge face of the workpiece, which may tend to enhance the gripping capability of the tool to the damaged pipe fitting. The addition of these features may in effect potentially augment the machining of the workpiece, by increasing the tool pressure and thereby improve the gripping effect by the tool on the broken edge face of the fitting to be extracted. Conversely, intentionally forming slight chamfers (22) or inside and outside corner radii (23) or sharp corners (23A), into the tool in these regions may improve the gripping effect of the tool by increasing the surface contact area between the tool's extraction engagement edges (8) and the broken fitting's exposed edge face. An affirmed conclusion regarding the most effective tool design strategy could be derived most effectively through experimentation and development of the tool configuration.

The apparatus 100 may also include slightly tapered pilot diameter(s) or flat(s) (28) to additionally facilitate pilot insertion into the broken fitting.

It should be noted that the above-mentioned embodiment features could be used in combination with one another, except in cases where two features may be in conflict. For example, if a tool were to have chamfers in a given area, then it would be impossible for those same areas to have corner radii.

Further Alternative Embodiment Features for the Male Pipe Thread Fitting Extraction Device With reference now to FIGS. 4A-4I, further possible features of the present teachings are illustrated. The extraction engagement edges (8) may be located above center plane (see FIG. 4D), on center plane (see FIG. 4E) or below center plane (see FIG. 4F), relative to the horizontal longitudinal axis center plane (32). Each configuration, in theory, is associated with advantages and disadvantages. Again, as earlier mentioned, the most advantageous configuration may only be derived through experimentation. The dimensions shown in this view are not fixed, but rather for illustrative purposes only and may be varied or adjusted without departure from the spirit and intent of the present invention. The "0.062" and "0.031" dimensions were chosen based purely upon practicality. Obviously, the smaller these dimensions are, the weaker the tool becomes, which would tend to increase the risk of breakage during use. It is possible to select more robust materials to make the tool from, which would enable these dimensions to be considerably smaller, but not without cost penalty. These particular embodiment features are completely and entirely compatible with ALL of the other embodiment features.

Figure 4A:
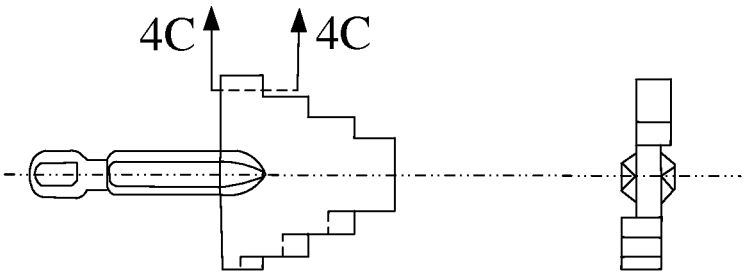
Figure 4B:
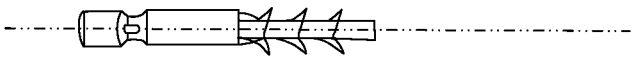
Figure 4C:
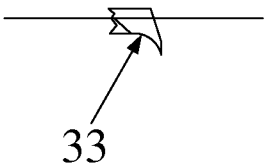

In one configuration, shown in FIG. 4A, for example, the engagement edge incorporates hook profile extraction engagement edges (33). The advantages of this design are realized both in the manufacture of the tool, because this engagement edge shape lends itself well to forming rather than machining the tool, as well as in function, whereby the tool has a greater opportunity to bite or dig into the pipe fitting and curl the stock, thereby wedging itself into the broken or damaged male pipe fitting edge, rather than machining it out.

Tool Profile

Figure 5A:
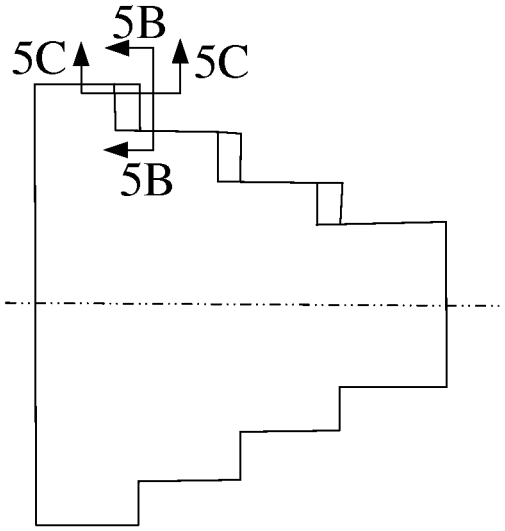
FIGS. 5A-5C provides various views detailing an extraction tool in accordance with the present teachings.
Figure 5B:
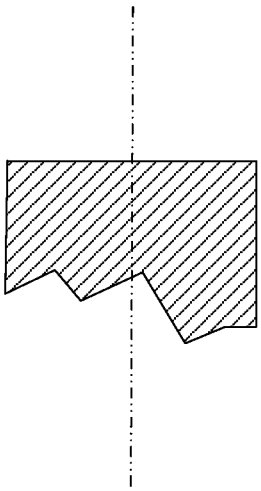
Figure 5C:
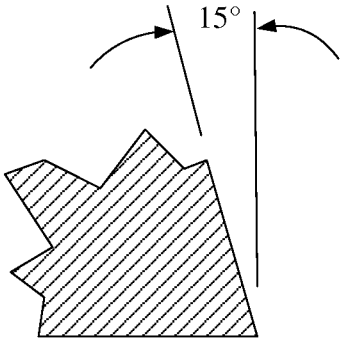

With reference to FIG. 5, a typical tool profile having nominal dimensions for a 0.375" tool thickness is illustrated. These dimensions were developed by test for schedule 40 pipe fittings, and once again, are typical nominals. Again, it should be noted that these dimensions, as well as their tolerances (not shown) may vary slightly, or can be adjusted without departing from the spirit of this invention. These dimensions will also vary with the schedule, grade or wall thickness of the pipe from which the fitting is made. Typically schedule 40 and schedule 80 pipe fittings are most common. The nominal dimensions shown should, under most conditions, perform adequately for both schedules 40 and 80 fittings.

Figure 6:
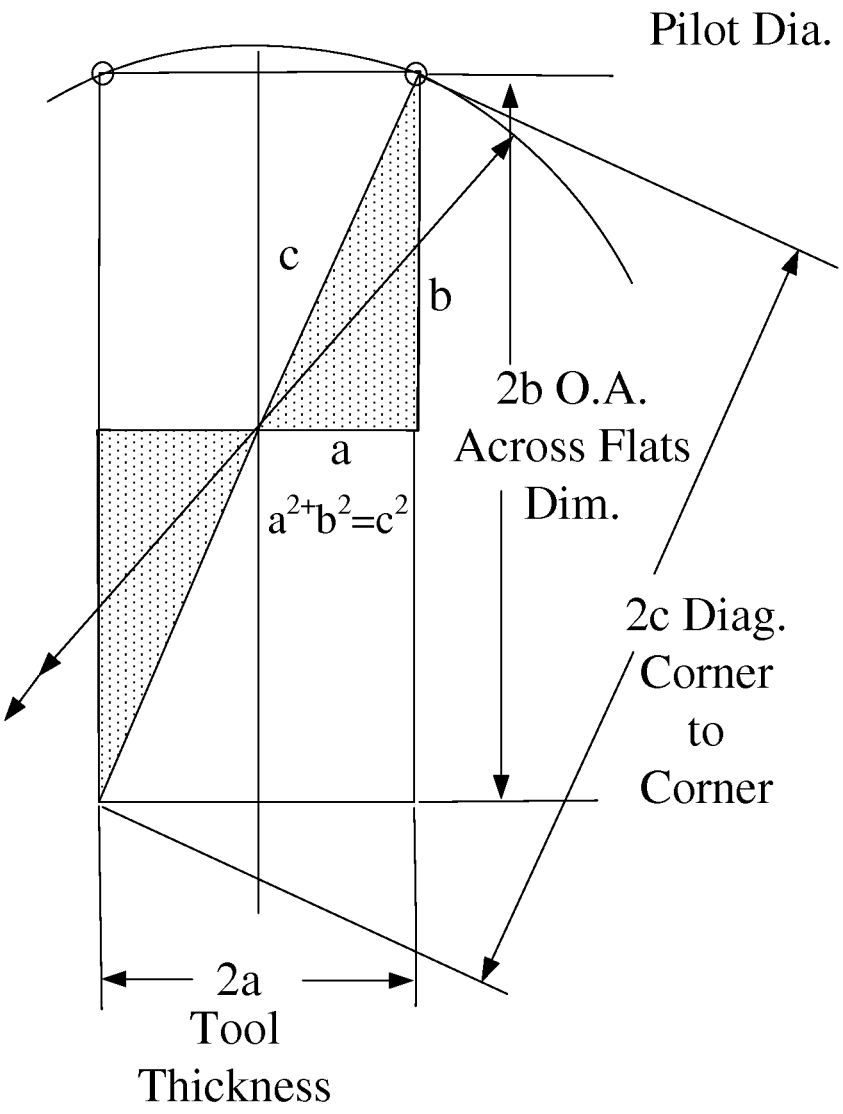
FIG. 6 illustrates the mathematical relationship of the across flat (pilot) dimension to the tool thickness, describing the trigonometric relationship present between the tool thickness and the resultant across flats tool pilot dimension(s) where applicable.
Figure 7A:
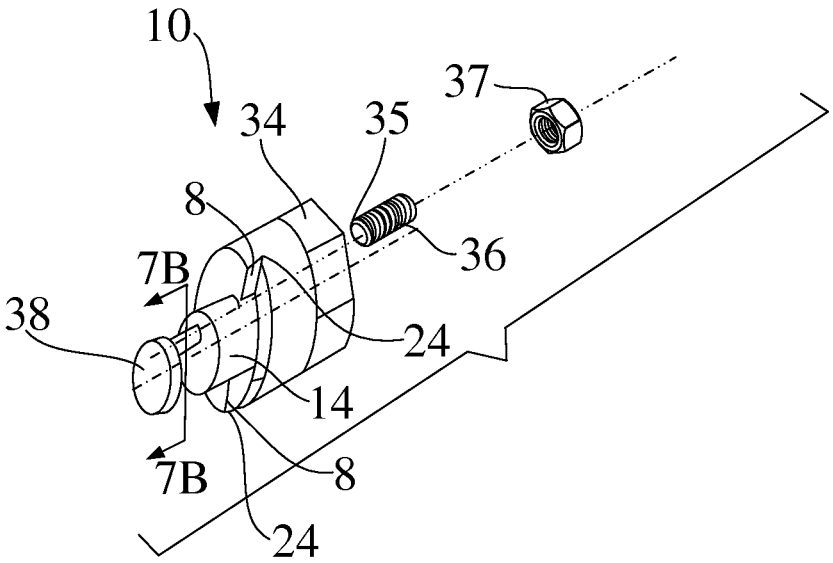
FIGS. 7A and 7B illustrate general steps of a method in accordance with the present teachings.
Figure 7B:
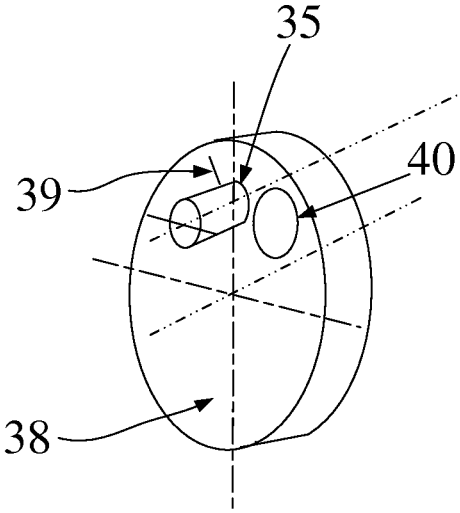

Referring now to FIG. 6, a mathematical relationship of the across flat (pilot) dimension to the tool thickness is illustrated. This illustration conveys a mathematical means for calculating the required extraction tool pilot "across flats" dimension, given the inside diameter of the pipe fitting to be extracted, hence, the required pilot diameter, while taking into account the (given or specified) thickness of the extraction tool to be designed. This trigonometric relationship between the given, desired or specified pilot diameter, is identical to the relationship of the sides of a right triangle, as is depicted in FIG. 6. Simply stated, a greater tool thickness, results in a smaller across flats dimension. This is because: if "a" (short or one leg of a right triangle) represents one-half of the extraction tool thickness; and "c" (the hypotenuse) represents the (given & fixed) pilot diameter's radius; where: a2+b2=c2; then: by definition, the greater "a" becomes, the lesser "b" must become, if in fact "c" is fixed and given. The intent of this mathematical relationship is to maintain that "2c" is equal to the fixed and given or desired pilot diameter necessary to fit snugly, yet comfortably into the inside diameter of the male pipe fitting to be extracted. In other words, the pilot diameter circumscribes the quadrilateral shape of the extraction tool's cross section, as in, the pilot diameter circle intersects all four (4) corners of the cross section of the tool. All of the above applies only at the tips of the extraction engagement edge corners.

Using a Right-Hand Thread Pipe Extraction Device

Figure 1B:
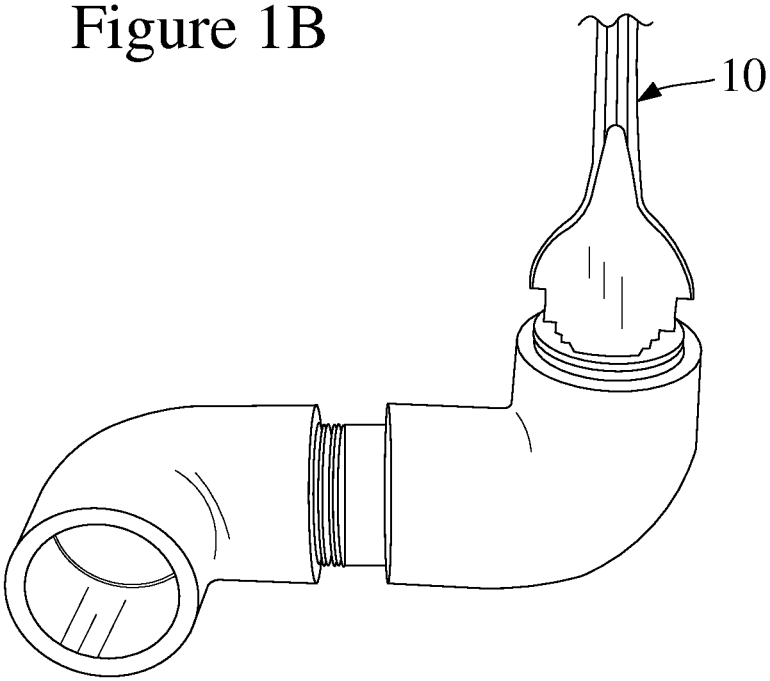
FIG. 1B is a perspective view of the male pipe fitting of FIG. 1A shown operatively associated with an extraction device of the present teachings.
Figure 2A:
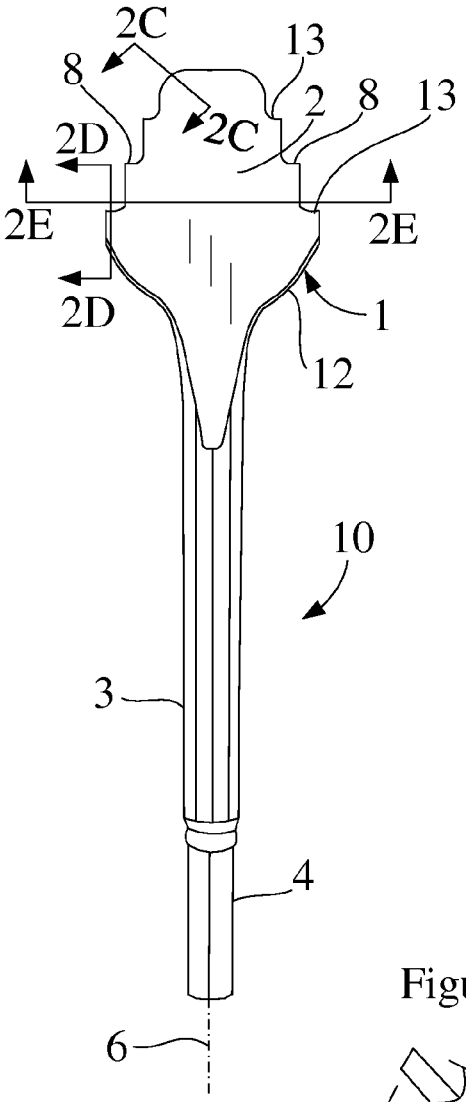
FIG. 2A is a side view of an extraction device constructed in accordance with the present teachings.
Figure 2B:
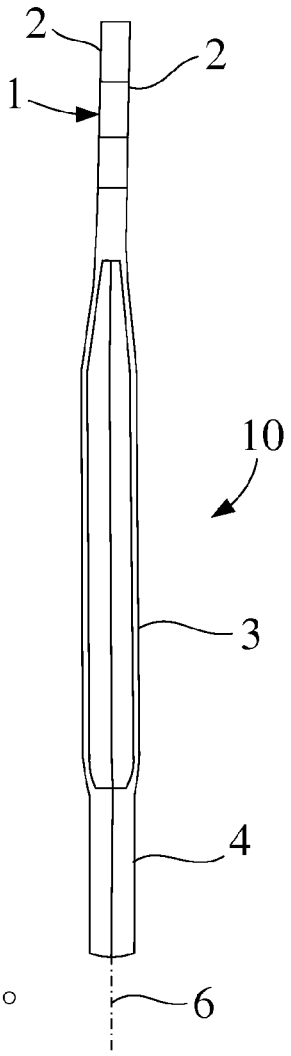
FIG. 2B is another side view of an extraction device constructed in accordance with the present teachings.
Figure 2C:
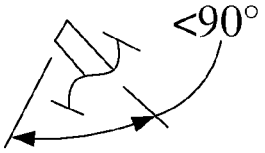
FIG. 2C is a cross-sectional view taken along the line 2C-2C of FIG. 2A.
Figure 2D:
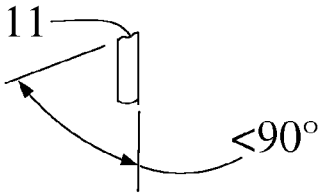
FIG. 2D is a cross-sectional view taken along the line 2D-2D of FIG. 2A.
Figure 2E:
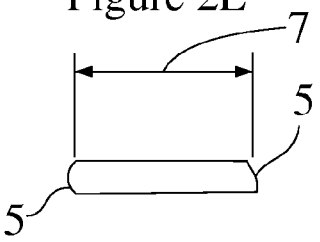
FIG. 2E is a cross-sectional view taken along the line 2E-2E of FIG. 2A.
Figure 3A:
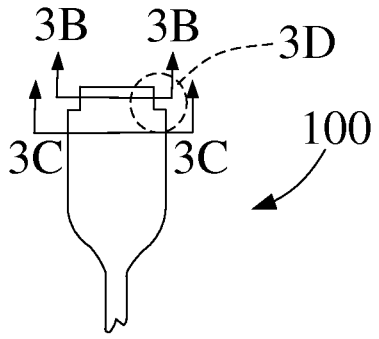
FIGS. 3A-3K provides various views of an extraction device in accordance with the present teachings.
Figure 3B:
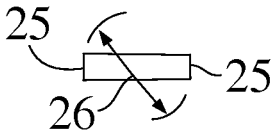
Figure 3C:
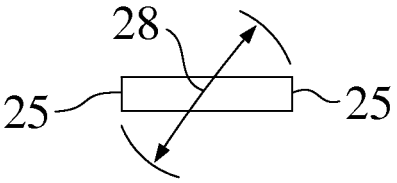
Figure 3D:
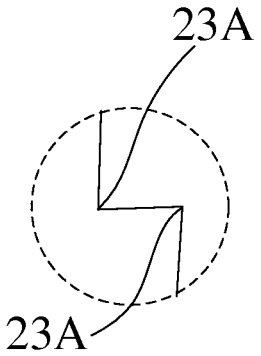
Figure 3E:
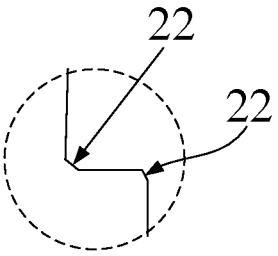
Figure 3F:
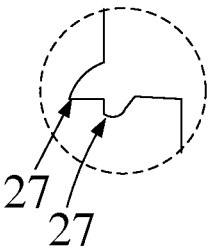
Figure 3G:
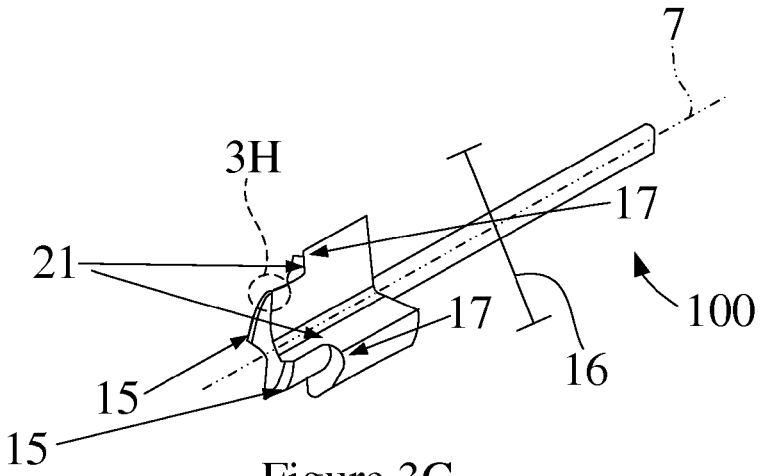
Figure 3H:
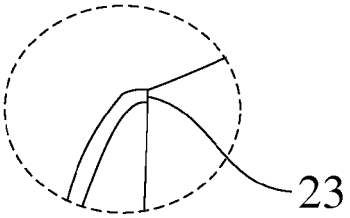
Figure 3I:
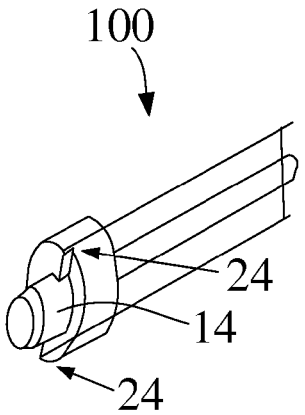
Figure 3J:
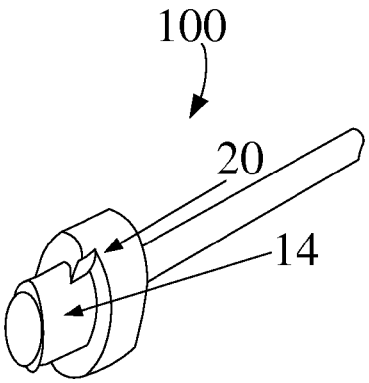
Figure 3K:
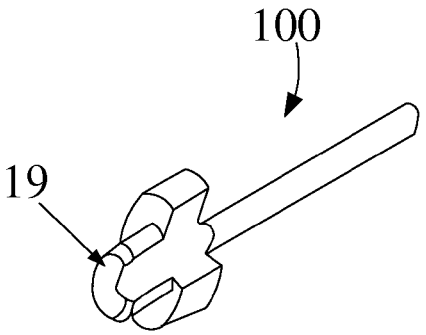

Turning to FIGS. 1A-1B, general steps in accordance with a method of the present teachings are illustrated. The apparatus 10 is inserted into and tightened within a suitable torque transmitting device, such as a reversible drill motor, tap wrench or other type of wrench capable of supplying sufficient removal torque in a counter-clockwise direction. If the torque transmitting device is electric powered, a variable speed device is recommended so that the removal torque may be applied gradually. Switch the torque transmitting device, if applicable, to left-hand or counter-clockwise rotation. Insert the tool's pilot into the inside diameter of the broken fitting to be extracted. While maintaining the tool's axis, coaxial with the broken fitting's axis, apply axial force to the tool with the torque transmitting device and gradually apply torque to the tool in a counter-clockwise direction. Continue to apply downward axial insertion force on the tool and gradually increase the torque until the fitting is fully extracted.

Using a Left-Hand Thread Pipe Extraction Device

The use of an apparatus designed to extract left-hand thread fittings is identical to the use of one designed for right-hand threads, except that the torque must be applied in the opposite or clockwise direction as viewed from the drive shank end of the tool.

Enhanced Extraction Device Features

With reference to FIGS. 9A-9B, still further features optional for an apparatus in accordance with the present teachings are illustrated. In this regard, the extraction apparatus may be enhanced to further diversify its usefulness under more widely varied application conditions in terms of positive male threaded pipe fitting extraction, primarily for, but not limited to use on metallic pipe fittings. Metallic pipe fittings often present a greater challenge while attempting extraction, due to the possibility of corrosion. The apparatus may include an integral drive portion (34). The integral drive portion (34) may be hexagonal, square or any other regular or non-regular polygon or quadrilateral shape. The apparatus may further include a retractable grip device shank (35) that inserts into a longitudinal bore, said bore passes entirely through the enhanced extraction device, said bore being eccentrically oriented, relative to the longitudinal center axis of the extraction tool. Said grip device may have a threaded portion (36) at one end, either left or right-handed thread, on the exposed outer end. The threaded portion (36) may thread into an adjustment nut (37), which may be comprised of a standard hex nut, or a lock nut of the crimped or staked, or plastic insert variety, and having an internal thread suitable for proper fit onto the threaded portion (36). The adjustment nut (37), is used to adjust, draw or retract the retractable grip device shank (35) and hence the grip device foot (38). The grip device foot (38), can be round, oval, square, or crescent in plan view shape, as well as any one of a number of shapes, either regular or irregular. The grip device foot (38) is no larger in overall diametrical size, than the cylindrical shaped pilot diameter (14), and is an integral part of the retractable grip device shank (35), along with the threaded portion (36). The grip device foot gripping surface (39) may be a plain, smooth surface, or equipped with a singular tooth or a multiple of teeth or knurl (40), and is also integral to the grip device foot (38). Said tooth, teeth, or knurl, if so equipped, are such that they are situated on the inboard side of the foot, facing the extraction engagement edges (8). The tooth or teeth may be situated in any orientation relative to the retractable grip device shank (35) and its related axis. If the grip device foot gripping surface (39) is equipped with a singular tooth, or a multiple of teeth, this tooth or teeth may be comprised of one or a number of tooth profile options, either a uniform peak tooth profile or a chisel point tooth profile. The grip device foot gripping surface (39) is intended to come in contact with the opposing end of the damaged/broken pipe fitting to be extracted. The grip device foot (38), may be arranged such that it is integrally and eccentrically affixed to the retractable grip device shank (35). In its "concentric position", the retractable grip device shank foot (38) may be concentric with the cylindrical shaped pilot diameter (14), of the enhanced extraction device. This allows the modified and enhanced extraction device's grip device foot (38) to pass freely through the inside diameter of the damaged male pipe fitting fully, until the grip device foot (38) is allowed to reach the opposite side of the pipe fitting to be removed. At this point the extraction engagement edges (8) would also be in contact with the broken edge face of the damaged fitting on the exposed end. Once the tool is fully inserted and seated, the retractable grip device shank (35) is rotated to its "eccentric rotated position", whereby the grip device foot (38) swings out radially from its previous "concentric position" to allow the grip device foot gripping surface (39) to align and come in contact with the opposing end of the male threaded pipe fitting to be extracted. If a right-hand thread is employed for the threaded portion (36), and the adjustment nut (37), then the rotational direction from the "concentric position" to the "eccentric rotated position" for the retractable grip device shank (35) would logically, but not necessarily be clockwise. This allows and ensures that as the adjustment nut (37), is tightened, this encourages the grip device foot (38) to swing into a position affording greatest possible engagement with the buried, undamaged face or end of the male pipe fitting, which is inside the female pipe fitting to be salvaged. The opposite would be true if a left-hand thread were to be used on the threaded portion (36), and adjustment nut (37), i.e. a left-hand thread would desirably and logically, but not necessarily utilize a counter-clockwise rotational direction for radial swing-out engagement of the retractable grip device shank (35), and the grip device foot (38). Also, it is logical but not imperative that a tool device designed to extract right-hand thread pipe fittings, utilize a left-hand thread on the threaded portion (36), and the adjustment nut (37), and vise-versa for a tool device designed for the extraction of left-hand thread male pipe fittings.

It is at this point that the minor diameter of the female thread fitting to be salvaged, acts as a radial swing stop for the grip device foot (38). Tightening of the adjustment nut (37) draws the extraction engagement edges (8) and the grip device foot (38) longitudinally closer together. Once the grip device foot gripping surface (39) and the extraction tool's extraction engagement edges (8) contact or engage with the opposing end faces of the damaged male pipe fitting, by virtue of tightening the adjustment nut (37), the damaged male pipe fitting is essentially clamped in between the extraction tool's grip device foot (38) and the extraction engagement edges (8). The enhanced extraction device has now essentially become as one with the broken pipe fitting. Now, the extraction tool may be rotated by the drive portion (34) in the appropriate direction for removal of the damaged pipe fitting, i.e. counter-clockwise for right-hand threaded pipe fittings and clockwise for left-hand threaded pipe fittings, as viewed from the drive portion (34) end, thus removing or extracting the damaged/broken male threaded pipe fitting.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A method of extracting a damaged, plastic male threaded pipe fitting from a counterpart female threaded pipe fitting, the method comprising:

providing an apparatus including:

a drive shank extending along an axis; and a blade portion including a pair of blade faces, a first pair of downwardly facing extraction engagement edges, and a first pair of edges defining, radially facing diametrically opposed, cylindrical pilot diameters;

engaging the damaged, plastic male threaded pipe fitting on an uppermost broken face or edge of the damaged male threaded pipe fitting;

maintaining a concentric relationship between the apparatus and the damaged, plastic male threaded pipe fitting with the first pair of radially facing diametrically opposed, cylindrical pilot diameters by disposing the first pair of diametrically opposed cylindrical pilot diameters close slip-fit within an inside diameter of the damaged, plastic male threaded pipe fitting; and rotating the damaged male threaded pipe fitting relative to the counterpart female threaded pipe fitting.

2. The method of claim 1, wherein:

the drive shank integrally extends from the blade portion; and the first pair of extraction engagement edges extends radially inward from the first pair of diametrically opposed, cylindrical pilot diameters.

3. The method of claim 2, wherein the apparatus further includes a pair tool clearance rake angle faces departing from the first pair of extraction engagement edges and forming an acute angle with a respective flat blade face of the apparatus.

4. The method of claim 1, wherein the blade portion is a flat blade portion.

5. The method of claim 1, wherein the pair of blade faces are flat blade faces.

6. The method of claim 1, wherein the first pair of diametrically opposed, cylindrical pilot diameters are perpendicular to the first pair of downwardly facing extraction engagement edges.

7. The method of claim 6, wherein the apparatus further includes a second pair of extraction engagement edges immediately adjacent and perpendicularly exposed relative to the first pair of diametrically opposed, cylindrical pilot diameters.

8. The method of claim 1, wherein the apparatus further includes a second pair of extraction engagement edges axially spaced from the first pair of extraction engagement edges.

9. The method of claim 8, wherein the apparatus further includes a third pair of extraction engagement edges.

10. The method of claim 9, wherein the first and second pairs of extraction engagement edges are axially spaced apart by the first pair of diametrically opposed, cylindrical pilot diameters; and the second and third pairs of extraction engagement surfaces are axially spaced apart by a second pair of diametrically opposed, cylindrical pilot diameters.

11. The method of claim 8, wherein the first and second pairs of extraction engagement edges are axially spaced apart by the first pair of diametrically opposed, cylindrical pilot diameters.

* * * * *